US006211850B1

(12) United States Patent
Komatsu

(10) Patent No.: US 6,211,850 B1
(45) Date of Patent: Apr. 3, 2001

(54) TIMING GENERATOR FOR DRIVING LCDS

(75) Inventor: Hidetoshi Komatsu, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 08/686,474

(22) Filed: Jul. 25, 1996

(30) Foreign Application Priority Data

Jul. 28, 1995 (JP) ..... P07-211309

(51) Int. Cl.[7] ..... G09G 3/36

(52) U.S. Cl. ..... 345/87; 345/99; 345/98; 345/211; 345/213

(58) Field of Search ..... 345/99, 211, 213, 345/98, 87, 131, 132

(56) References Cited

U.S. PATENT DOCUMENTS 4,479,119 * 10/1984 Sakano ..... 340/731
5,406,308 * 4/1995 Shiki ..... 345/127
5,430,457 * 7/1995 Zenda ..... 345/3
5,506,602 * 4/1996 Yokoyama ..... 345/132
5,606,348 * 2/1997 Chiu ..... 345/213
5,675,355 * 10/1997 Chiu et al. ..... 345/99
5,731,798 * 3/1998 Shin ..... 345/99
5,767,830 * 6/1998 Kawamura ..... 345/99
5,821,910 * 10/1998 Shay ..... 345/99
5,841,430 * 11/1998 Kurikko ..... 345/213
5,859,626 * 1/1999 Kawamura ..... 345/99
5,870,070 * 2/1999 Furukawa et al. ..... 345/99

* cited by examiner

*Primary Examiner*—William A. Cuchlinski, Jr.
*Assistant Examiner*—Marthe Y. Marc-Coleman
(74) *Attorney, Agent, or Firm*—Sonnenschein, Nath & Rosenthal

(57) ABSTRACT

The present invention provides a display apparatus comprising: a decoder/driver for receiving a video signal, extracting a synchronization signal from the video signal and generating an image signal from the video signal; a timing generator for generating timing control pulses in accordance with the synchronization signal; and a display panel for writing the image signal sequentially into picture elements in accordance with the timing control pulses. The timing generator employed in the display apparatus comprises: internal pulse generating means for generating internal pulses; an external data input unit for receiving external data; a data table for holding the external data received by the external data input unit; an adjusting unit for adjusting the output frequency and output timing of the internal pulses in accordance with the external data stored in the data table; and timing control pulse generating means for generating the timing control pulses in accordance with the internal pulses controlled by the control means.

9 Claims, 3 Drawing Sheets

TIMING GENERATOR FOR DRIVING LCDS

BACKGROUND OF THE INVENTION

1. Field of the Invention

The present invention relates to a timing generator for driving LCDs. To put it in detail, the present invention relates to a timing generator for driving LCDs which timing generator allows the frequency and the timing of pulses output thereby to be controlled by an external signal.

2. Description of Related Art

A driver and a timing generator are used for driving an LCD (Liquid Crystal Display) panel.

Therefore, in order to drive an LCD panel of a specific type, a timing generator specially intended for the type needs to be developed.

As a result, a timing generator can only be used specially for an LCD panel of a type for which the timing generator is designed and the timing of pulses output thereby is fixed.

In addition, with respect to the system configuration, a special system is also required for the same reasons.

As described above, in the conventional timing generator, the timing of pulses output thereby is fixed so that only images having signal specifications matching the timing can be displayed on the LCD panel, giving rise to a problem that an image having different signal specifications from the timing of the output pulses can not be displayed correctly.

In addition, as has already been described, the frequency of pulses output by the timing generator and the timing thereof are fixed.

Accordingly, only an LCD panel of a specific type can be driven by the timing generator.

For this reason, timing generators of various types need to be made available for LCD panels of different types.

As described above, the timing of pulses output by the conventional timing generator is fixed, giving rise to a problem that the frequency and timing of a timing generator of a particular type can not be controlled when used for driving an LCD panel of a different type.

SUMMARY OF THE INVENTION

The present invention provides a timing generator with several functions. That is to say, the timing generator of a particular type provided by the present invention can be used for driving LCD panels of a plurality of different types.

In accordance with one aspect of the present invention, there is provided a timing generator for supplying timing control pulses to a display panel, which comprises: internal pulse generating means for generating internal pulses; an external data input unit for receiving external data; a data table for holding said external data received by the external data input unit; control means for controlling the output frequency and output timing of the internal pulses in accordance with the external data stored in the data table; and timing control pulse generating means for generating timing control pulses in accordance with the internal pulses controlled by the control means.

Preferably, the internal pulse generating means comprises a basic pulse generating unit for generating basic pulses and a counter for generating a pulse for each predetermined number of basic pulses generated by the basic pulse generating unit.

The external data may be a value to be set in the counter and when the number of pulses output by the counter becomes equal to the external data, the timing control pulse is generated.

The timing generator may further comprise a processing means for calculating the frequency of the timing control pulses and determining output timing of the timing control pulses.

The internal pulse generating means may comprise a PLL circuit and a frequency dividing counter.

The external data may be a frequency divisor of the frequency dividing counter.

In accordance with another aspect of the present invention, there is provided a display apparatus which comprises: a decoder/driver for receiving a video signal, extracting a synchronization signal from the video signal and generating an image signal from the video signal; a timing generator for generating timing control pulses in accordance with the synchronization signal; and a display panel for writing the image signal sequentially into picture elements in accordance with the timing control pulses, wherein the timing generator comprises: internal pulse generating means for generating internal pulses; an external data input unit for receiving external data; a data table for holding the external data received by the external data input unit; control means for controlling the output frequency and output timing of the internal pulses in accordance with the external data stored in the data table; and timing control pulse generating means for generating the timing control pulses in accordance with the internal pulses controlled by the control means.

Preferably, the internal pulse generating means comprises a basic pulse generating unit for generating basic pulses and a counter for generating a pulse for each predetermined number of basic pulses generated by the basic pulse generating unit.

The external data may be a value to be set in the counter and when the number of pulses output by the counter becomes equal to the external data, the timing control pulse is generated.

According to the present invention, by providing the timing generator for driving LCDs with a communication function for allowing communication with the external world to take place, the timing of pulses output by the timing generator can be controlled by using an external signal.

To put it in concrete terms, by controlling a set value (or decode value) of an internal counter provided inside the timing generator using an external signal, control to vary the frequency and the output timing of LCD driving pulses and internal pulses can be implemented.

By enabling the control to vary the timing of output pulses using an external signal as described above, a timing generator of only a particular type can be used for driving LCD panels having a variety of types.

In addition, by providing a processing circuit embedded in the timing generator, the amount of control data supplied by an external source can be reduced and the decode data of the counter can be controlled into a variety of values, allowing the configuration of the timing generator to be simplified.

DETAILED DESCRIPTION OF THE PREFERRED EMBODIMENTS

The present invention will become apparent from the following detailed description of preferred embodiments of a timing generator for driving LCDs provided by the present invention with reference to accompanying diagrams.

By adjusting data provided by an external unit such as a microcomputer, the timing generator for driving LCDs provided by the present invention can display a plurality of video signals of different types on an LCD panel.

Figure 1:
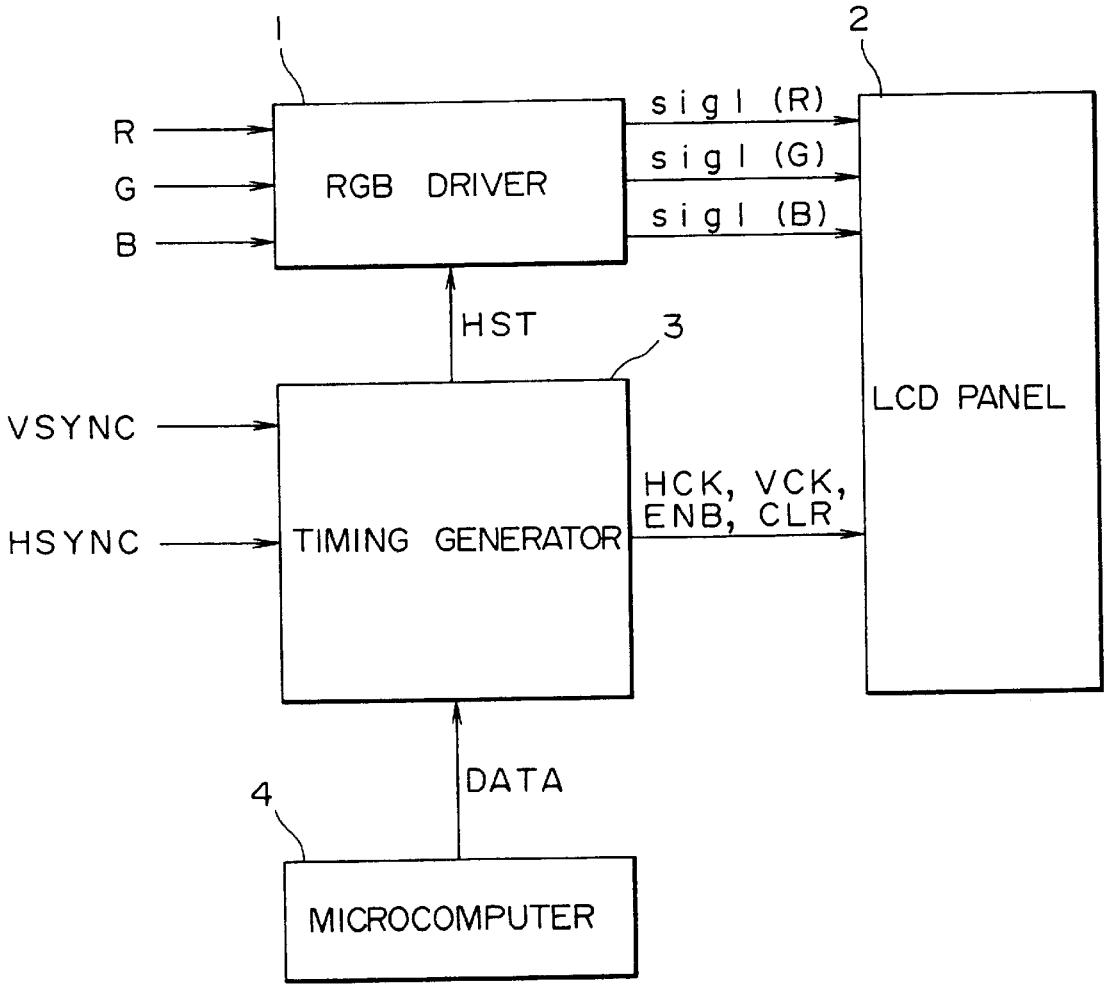
FIG. 1 is a functional block diagram showing an embodiment implementing the basic configuration of a system for driving an LCD panel by means of a timing generator 3 provided by the present invention.

FIG. 1 is a functional block diagram showing an embodiment implementing the basic configuration of a system for driving an LCD panel by means of a timing generator provided by the present invention. Reference numerals 1 and 2 shown in the figure denote an RGB driver and an LCD panel respectively. Reference numeral 3 is a timing generator whereas reference numeral 4 denotes a microcomputer.

Notations R, G and B denote red, green and blue input signals respectively. Notations sigl(R), sigl(G) and sigl(B) are driving signals of the LCD panel. Notations VSYNC and HSYNC are vertical and horizontal synchronization signals respectively. Notation HST denotes a start pulse of the horizontal direction display. Notations HCK and VCK denote horizontal and vertical clock signals respectively. Notation ENB denotes an enable signal whereas notation CLR is a clear signal. Notation DATA denotes data for control purposes.

As shown in FIG. 1, the RGB driver 1, the timing generator 3 and the microcomputer 4 are required for driving the LCD panel 2.

The RGB driver 1 adopts the conventional configuration and signals output by the timing generator 3 are basically the same as the conventional ones.

However, the microcomputer 4 is connected to the timing generator 3 as an external unit. The timing generator 3 provided by the present invention is different from the standard one in that communication takes place between the microcomputer 4 and the timing generator 3 provided by the present invention.

As has been described earlier, special LCD driving pulses are required for driving the LCD panel 2 of a particular type. The specific LCD driving pulses are controlled by the timing generator 3.

In the system shown in FIG. 1, the LCD driving pulses include the horizontal clock signal HCK, the vertical clock signal VCK and the enable signal ENB.

In order to output such LCD driving pulses, the timing generator 3 comprises a basic pulse generating unit for generating a basic clock signal, a counter for generating a pulse for every predetermined number of basic pulses, a timing control means for controlling the phase of generated pulses in order to establish synchronization with the vertical synchronization signal VSYNC and the horizontal synchronization signal HSYNC.

The frequency and timing of the LCD driving pulses, that is, the frequency and timing of pulses output by the timing generator 3, is controlled by the frequency and timing of internal pulses of the timing generator 3.

The frequency of the internal pulses of the timing generator 3 is provided by the microcomputer 4 as a set value of the internal counter 6, that is as control data DATA.

Next, a block unit of the timing generator 3 for receiving the control data DATA supplied by the microcomputer 4 is explained. The block unit is referred to hereafter as the so-called communication functional unit.

Figure 2:
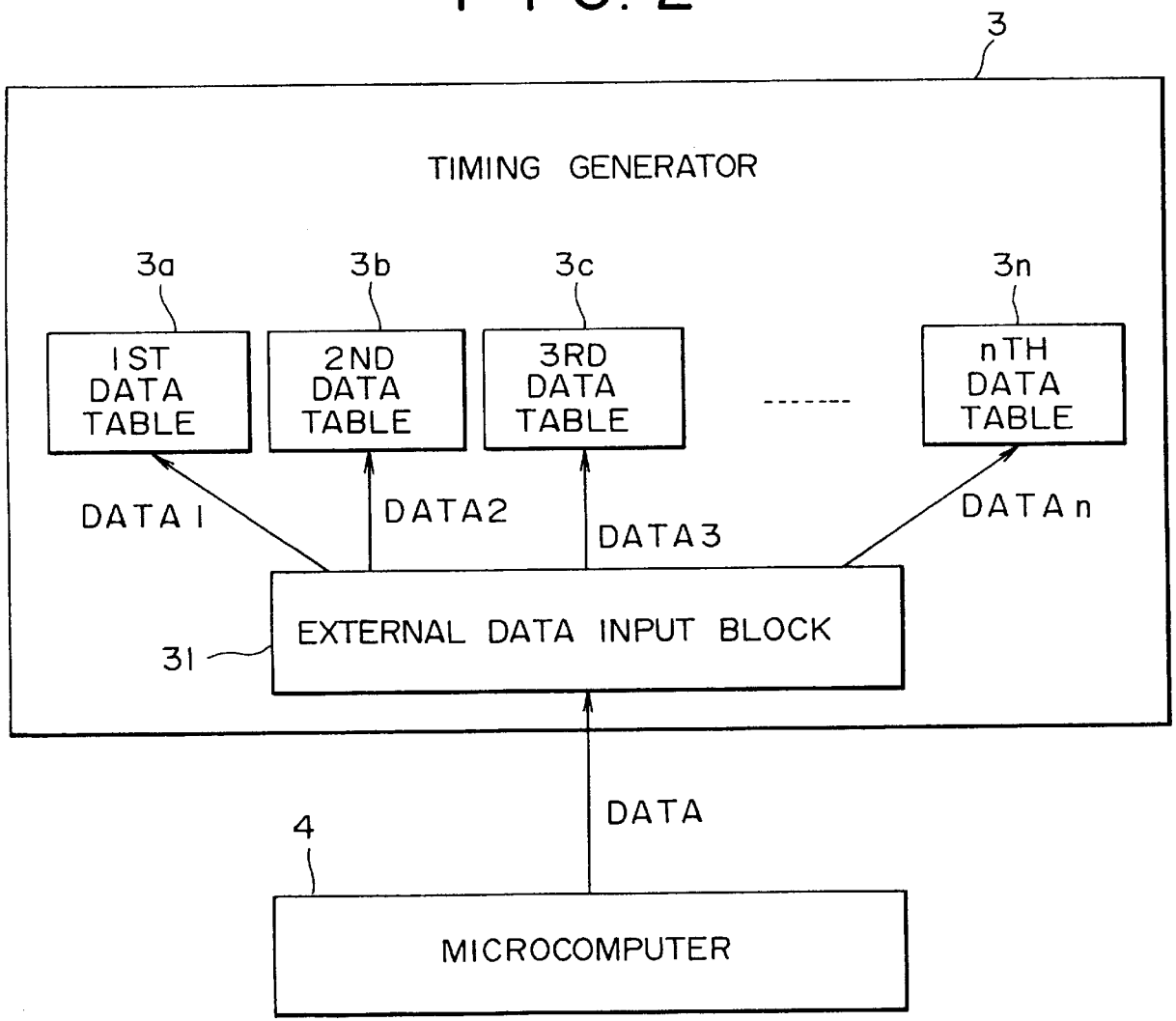
FIG. 2 is a functional block diagram showing an embodiment implementing the main component configuration of the communication functional unit of the timing generator 3 shown in FIG. 1.

FIG. 2 is a functional block diagram showing an embodiment implementing the main component configuration of the communication functional unit of the timing generator 3. In the figure, the same reference numerals and notations as those shown in FIG. 1 are used. Reference numerals 3*a* to 3*n* are 1st to nth data tables respectively. Reference numeral 31 is an external data input control unit. Notations DATA1 to DATAn each denote control data.

As shown in FIG. 2, the timing generator 3 includes the external data input control unit 31 and n pieces of data tables 3*a* to 3*n* for storing control data DATA1 to DATAn (or count values), set values of the internal counter.

External data is transmitted by the microcomputer 4 to the timing generator 3 by using the serial transmission technique. As shown in the figure, the external data is received by the external data input control unit 31 provided in the timing generator 3.

Control data DATA received by the external data input control unit 31 is stored in the 1st to nth data table 3*a* to 3*n* as the control data DATA1 to DATAn respectively.

The control data DATA1 to DATAn are each a set value provided for the internal counter as an N-bit count value where N is typically 4.

In the case of the timing generator 3 shown in FIG. 1, external data is received by a circuit like the one shown in FIG. 2.

Since the frequency of the LCD driving pulses is controlled by the count value provided by an external source, the microcomputer 4 in this case, it is not necessary to decode the data inside the timing generator 3.

Figure 3:
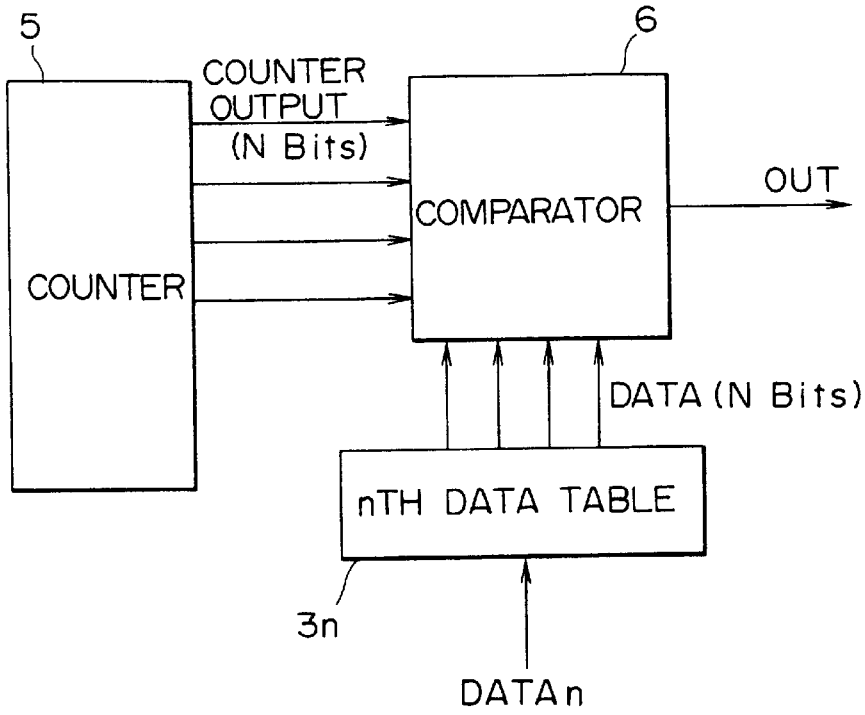
FIG. 3 is a functional block diagram showing an embodiment implementing the main component configuration of a pulse count controlling unit embedded in the timing generator 3 shown in FIG. 1.

FIG. 3 is a functional block diagram showing an embodiment implementing the main component configuration of a pulse count controlling unit embedded in the timing generator 3 shown in FIG. 1. Reference numeral 3*n* shown in the figure is an nth data table. Reference numerals 5 and 6 are a counter and a comparator respectively.

As has already been explained by referring to FIG. 2, in order to drive an LCD panel of a particular type, a timing generator 3 that controls special LCD driving pulses is used.

In the case of the timing generator 3 provided by the present invention, on the other hand, it is possible to carry out control to vary the frequency of the LCD driving pulses. Control data DATA supplied by the external microcomputer 4 is stored in one data table, for example, the nth data table 3*n*.

FIG. 3 shows a configuration wherein the output of the counter 5 is 4 bits in width. In this case, control data DATA is also supplied as 4-bit data as well.

In general, for an N-bit output of the counter 5, the control data DATA is also N bits in width as well.

The comparator 6 compares the output of the counter 5 (that is, the count value) with control data DATA set in the nth data table 3*n*. If both are found equal to each other, the comparator 6 outputs a positive polarity (H-level) pulse to indicate data coincidence.

It should be noted that, in the case of a negative logic circuit, a negative polarity (L-level) pulse is output to indicate the data coincidence.

By carrying out the operation described above, the frequency of the basic clock signal is divided by the count value (the counter decode value) which is provided as control data DATA and the result of the division is used as a frequency of a signal for controlling the LCD driving pulses.

In this case, by controlling the reset timing of the counter 5, the phase of the LCD driving pulses, that is, the timing of the LCD driving pulses, can be controlled.

It should be noted that, in the case of the conventional timing generator 3, the control data DATA is fixed so that control is carried out to always generate LCD driving pulses with a constant frequency.

Figure 4:
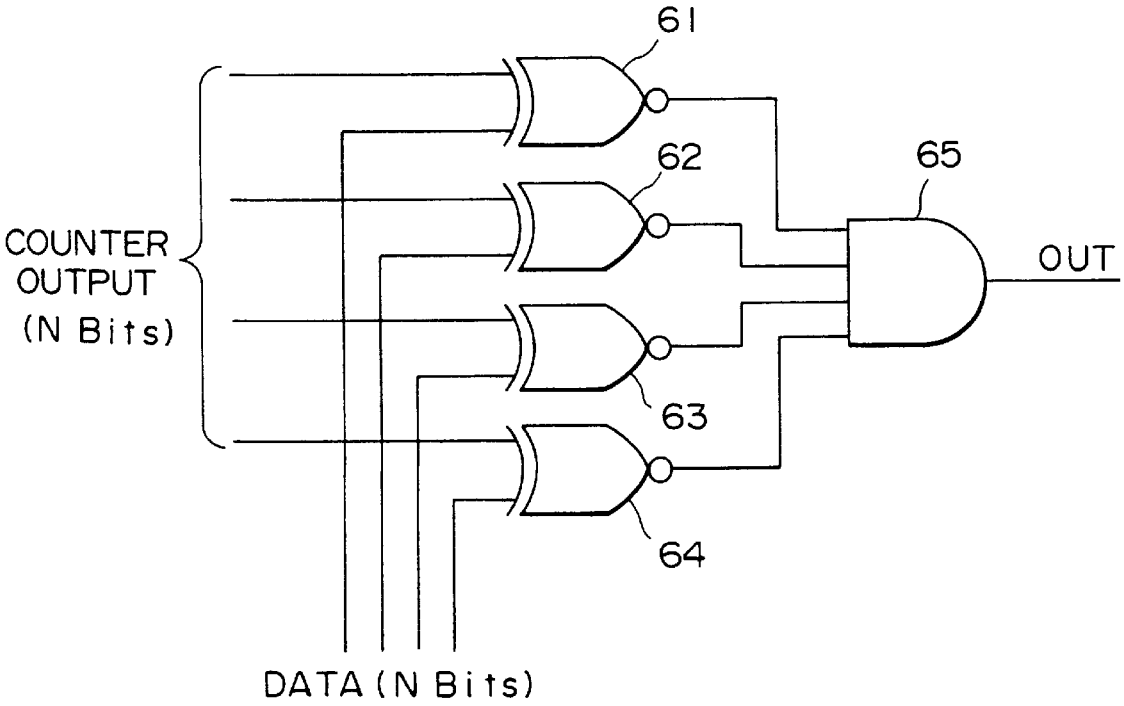
FIG. 4 is a functional block diagram showing an embodiment implementing the main component configuration of a comparator 6 shown in FIG. 3.

FIG. 4 is a functional block diagram showing an embodiment implementing the main component configuration of the comparator 6 shown in FIG. 3. Reference numerals 61 to 64 each denote an exclusive OR circuit whereas reference numeral 65 is an AND circuit.

As shown in FIG. 4, the comparator 6 shown in FIG. 3 comprises the exclusive OR circuits 61 to 64 which each correspond to an output bit of the counter 5 and the AND circuit 65 for inputting signals output by the exclusive OR circuits 61 to 64.

In the case of the comparator 6 having a configuration shown in FIG. 4, the 4 bits output by the counter 5 are compared with bits of the external data by the exclusive OR circuits 61 to 64 to determine whether or not all the bits output by the counter 5 match the bits of the external data.

If all the bits output by the counter 5 are found equal in value to the bits of the external data, an AND condition is satisfied, causing the AND circuit 65 to output a positive polarity (H-level) pulse in the case of a positive logic circuit.

It should be noted that, in this case, a NAND circuit can be employed in place of the AND circuit 65 to output a negative polarity (L-level) pulse in the case of a negative logic circuit.

As described above, the output of the counter 5 in the embodiment described above is 4 bits in width. In the case of an N-bit counter output, N pieces of exclusive OR circuits 61 to 6N are provided and the outputs of the exclusive OR circuits 61 to 6N are provided to an AND circuit having N inputs.

By the way, FIG. 2 shows a case in which n pieces of data tables 3*a* to 3*n* are provided.

In the timing generator 3, however, in many cases, the set count values of the internal counter 5 are related to each other. That is to say, with one of the count values taken as a reference, the other count values are equal to ½, ¼ or other fractions or a multiple of the reference in many cases.

Here, a processing circuit can thus be employed in place of the data tables 3*a* to 3*n* shown in FIG. 2 and the pulse count controlling circuit shown in FIG. 3 in order to allow the frequency and timing of the LCD driving pulses to be controlled even more easily.

Let, for example, control data DATA supplied from an external source be used as a reference. If only count values equal to half or twice the reference or a count value resulting from addition, subtraction, multiplication or division with respect to the reference is to be used as a set value of the counter, the number of control data pieces to be supplied from the external source can be reduced.

In such a configuration, blocks to be added in the timing generator 3 can also be simplified as well.

2nd Embodiment

In addition, as another embodiment of the present invention, a PLL (Phase Locked Loop) circuit is provided to allow an external source to carry out control to vary the divided frequency output by the frequency dividing counter.

Frequency dividing counter as such, the size of a picture that can be displayed on the LCD panel can be changed arbitrarily.

In this case, by changing the output timings of the start pulse VST of the vertical direction display and the start pulse HST of the horizontal direction display, the position of a picture displayed on the LCD panel can be changed freely.

As described above in detail, the communication function of the timing generator provided by the present invention allows control data to be supplied by an external apparatus such as a microcomputer.

By adjusting the control data to specifications of a predetermined LCD panel, an LCD panel having different specifications can be driven and controlled.

That is to say, a timing generator of a particular type can be used for driving and controlling LCD panels of a plurality of different types.

In addition, with a particular system, it is possible to drive and control LCD panels of a plurality of different types.

What is claimed is:

1. A timing generator for supplying timing control pulses to a display panel, said timing generator comprising:

a frequency adjusting unit for adjusting a frequency of timing control pulses output from said timing generator by a fixed external input, said frequency adjusting unit having:

a basic pulse generating unit for generating basic pulses;

a counter for counting said basic pulses; and a means for outputting said timing control pulse after said counter counts a predetermined number of basic pulses;

wherein said predetermined number is equal to said fixed external input.

2. The timing generator according to claim 1, further comprising a processing means for calculating the frequency of said timing control pulses and determining an output timing of said timing control pulses.

3. The timing generator according to claim 1, wherein the means for adjusting further comprises a PLL circuit and a frequency dividing counter.

4. The timing generator according to claim 3, wherein said fixed external input is a frequency divisor of said frequency dividing counter.

5. A display apparatus comprising:

a decoder/driver for receiving a video signal, extracting a synchronization signal from said video signal and generating an image signal from said video signal;

a timing generator for generating timing control pulses in accordance with said synchronization signal; and a display panel for writing said image signal sequentially into picture elements in accordance with said timing control pulses, wherein said timing generator comprises:

a frequency adjusting unit for adjusting a frequency of said timing control pulses by a fixed external input, said frequency adjusting unit having:

a basic pulse generating unit for generating basic pulses;

a counter for counting said basic pulses; and a means for outputting said timing control pulse after said counter counts a predetermined number of basic pulses;

wherein said predetermined number is equal to said fixed external input.

6. The display apparatus according to claim 5, further comprising a processing means for calculating the frequency of said timing control pulses and determining output timing of said timing control pulses.

7. The display apparatus according to claim 5, further comprising a PLL circuit and a frequency dividing counter.

8. The display apparatus according to claim 7 wherein said fixed external input is a frequency divisor of said frequency dividing counter.

9. A method for supplying timing control pulses to a display panel, said method comprising the steps of:

providing a display panel;

connecting a timing generator to said display panel;

adjusting a frequency of timing control pulses output from said timing generator by:

generating basic pulses;

counting said basic pulses; and after counting a predetermined number of basic pulses, outputting said timing control pulse, said predetermined number being equal to a fixed external input; and supplying said adjusted timing control pulses to said display panel.

* * * * *